US007726775B2

(12) United States Patent
Maeda

(10) Patent No.: US 7,726,775 B2
(45) Date of Patent: Jun. 1, 2010

(54) LIQUID EJECTION RECORDING HEAD AND LIQUID EJECTION RECORDING APPARATUS

(75) Inventor: Hiroyuki Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 338 days.

(21) Appl. No.: 11/949,434

(22) Filed: Dec. 3, 2007

(65) Prior Publication Data

US 2008/0129778 A1 Jun. 5, 2008

(30) Foreign Application Priority Data

Dec. 1, 2006 (JP) ..... 2006-325950
Oct. 17, 2007 (JP) ..... 2007-270108

(51) Int. Cl.
*B41J 23/00* (2006.01)

(52) U.S. Cl. ..... 347/37; 347/77

(58) Field of Classification Search ..... 347/37, 347/40, 77, 82, 85–86, 89
See application file for complete search history.

(56) References Cited

U.S. PATENT DOCUMENTS

2008/0284818 A1* 11/2008 Anagnostopoulos ..... 347/40

FOREIGN PATENT DOCUMENTS

| | | |
|---|---|---|
| JP | 2000-255083 | 9/2000 |
| JP | 2002-103626 | 4/2002 |
| JP | 2002-337318 | 11/2002 |

* cited by examiner

*Primary Examiner*—Thinh H Nguyen
(74) *Attorney, Agent, or Firm*—Fitzpatrick, Cella, Harper & Scinto

(57) ABSTRACT

A liquid ejection recording head includes a liquid ejecting portion for ejecting liquid; a casing having a first side provided with the liquid ejecting portion, and a second side different from the first side; a first opening provided between the liquid ejecting portion and an edge of the first side; a second opening which is provided in the second side and which is in fluid communication with the first opening; and a projection provided in the second side between the second opening and such an edge of the second side as corresponds to the edge of the first side.

12 Claims, 7 Drawing Sheets

LIQUID EJECTION RECORDING HEAD AND LIQUID EJECTION RECORDING APPARATUS

FIELD OF THE INVENTION AND RELATED ART

The present invention relates to a liquid ejection recording head which records with liquid jetted from its liquid ejection portion while being moved relative to recording medium. It also relates to a recording apparatus employing a liquid ejection recording head.

In recent years, in order to record at a significantly higher level of resolution than achievable with the use of a liquid ejection recording apparatus in accordance with the prior art, various efforts have been made to develop technologies for enabling a liquid ejection recording head to jet a microscopic liquid droplet (which is no more than one pico-litter in volume) so that the dot which each liquid droplet forms on recording medium as it lands on recording medium will be significantly smaller than a dot formed by a liquid ejection recording head in accordance with the prior art, along with the efforts made to develop technologies for enabling a liquid ejection recording head to jet a liquid droplet at a significantly higher velocity than achievable by a liquid ejection recording head in accordance with the prior art.

In the case of an ordinary ink jet printer, an image is formed by alternately repeating the process of conveying a sheet of recording medium, and the process of moving a recording head for ejecting ink droplets upon the sheet of recording medium, in the direction intersectional (perpendicular) to the direction in which the sheet of recording medium is conveyed. In the field of an ink jet recording printer, such as the above described one which jets minuscule droplet of liquid at a higher speed, it is very important to develop technologies that can prevent each of the numerous microscopic liquid droplets from landing away from its preset landing point on a sheet of recording medium.

Some of the causes for the problem that a minuscule droplet of liquid jetted from an ink jet recording head lands on a point on recording medium, which is away from its preset landing point on the recording medium, are: the structure of a nozzle from which a liquid is jetted; the adhesion of ink to the surface of an ink jet recording head, which coincides with the plane of the opening of each nozzle; the vibrations and/or tilt of the carriage on which the ink jet recording head or heads are mounted; the aerial turbulence which occurs between an ink jet recording head and a sheet of recording medium; the warping of a sheet of recording medium; etc.

In particular, the problem that the aerial current which occurs between an ink jet recording head and a sheet of recording medium causes a liquid droplet jetted from the ink jet recording head to land on a point on the sheet of recording medium, which is different from a preset landing point therefor on the sheet of recording medium, is referred to as landing point deviation attributable to aerial current (which hereafter will be referred to as dot deviation (attributable aerial current)). For example, the phenomenon that a liquid droplet jetted from one of the end portions of a row of liquid ejecting openings is made to drift inward, that is, toward the center of the row of liquid ejecting openings in terms of the direction parallel to the row of liquid ejecting openings, may arise. If the inward drifting occurs to the liquid droplets jetted from the liquid ejecting outlets in the end portion of the row of liquid ejecting openings, an image suffering from multiple unwanted white stripes, which correspond in position to the borders between the adjacent two multiple passes which the ink jet recording head 1 makes across the recording medium 7 to complete the image, is yielded. Therefore, earnest efforts have been aggressively made to develop technologies for improving an ink jet (liquid ejection recording head) from the standpoint of preventing the above described inward drifting of a liquid droplet (Japanese Laid-open Patent Applications 2002-103626, and 2002-337318). It has been known that the aerial current which causes the liquid (ink) droplets jetted from the end portion of a row of liquid ejecting openings is the very aerial current which each liquid droplet generates (which hereafter will be referred to as self induced aerial current).

There are other types of aerial current than the self-induced aerial current. One of them is the aerial current that is made to occur between the ink jet recording head and sheet of recording medium by the movement of a carriage. An ink jet recording apparatus forms an image by causing numerous minuscule liquid droplets to land on a sheet of paper (recording medium), and therefore, the dot which each liquid droplet forms is very small. Therefore, in order to reduce an ink jet recording apparatus the length of time required per copy, it is necessary to increase the speed at which the carriage is moved. The higher the speed of the carriage, the greater the amount by which air is made to flow into the gap between the ink jet recording head and sheet of paper (recording medium), by the movement of the carriage. Each liquid droplet jetted out of the ink jet recording head is extremely small in quantity. Therefore, its line of flight (or trajectory) is significantly affected by the amount by which air is made to flow into the gap between the ink jet recording head and sheet of paper. Further, if the amount by which air is made to flow into the gap between the ink jet recording head and sheet of recording head exceeds a certain value, the liquid (ink) droplets jetted from the portion of the row of liquid ejecting openings, which is closer to the center of the row of liquid ejecting openings, are made to drift toward the center of the row of liquid ejecting openings, causing the ink jet recording apparatus to yield an image suffering from multiple unwanted stripes, each of which is abnormally darker than the adjacent areas, and corresponds in position to the center portion of one of the multiple passes which the ink jet recording head has to make to complete the image.

In the case of the prior art, the inward drifting of the liquid (ink) droplets from the portion of the row of liquid ejecting openings, which is on the immediately inward side of each of the lengthwise end portions of the row of liquid ejecting openings, has not been taken into consideration. However, in recent years, an ink jet recording head has been increased in the number of rows of liquid ejecting openings in response to the increase in the number of inks, different in color, used for image formation. Therefore, it is difficult to make uniform the entirety of the gap between the ink jet recording head and sheet of paper (recording medium) in terms of the electric field applied to a liquid droplet. Further, the inward drifting of a liquid droplet jetted from the portion of the row of liquid ejecting openings, which is closer to the center of the row of liquid ejecting openings, is greater than the inward drifting of a liquid droplet from the lengthwise end portion of the row of liquid ejecting openings. Therefore, it is difficult to prevent (minimize) the former with the use of the mechanism for preventing (minimizing) the latter.

On the other hand, there is an ink jet recording head which has multiple rows of liquid ejecting openings, and a row of ink suctioning holes, which is positioned next to one of the outermost rows of liquid ejecting openings to remove the mist of ink in the internal space of the printer (Japanese Laid-open Patent Application 2000-255083). The structural arrangement of this ink jet recording apparatus was not intended to solve the above described problem that the liquid (ink) droplets jetted from the portion of the row of liquid (ink) ejecting openings, which is closer to the center of the row of liquid (ink) ejecting openings, are made to drift toward the center of the rows. Moreover, the printer was provided with a negative pressure generating means, which was located within the printer to suction the ink droplets floating in the printer, and was structured so that this negative pressure generating means was utilized to suction, through the row of ink suctioning holes and a piece of tube, the body of air in the gap between the recording head and sheet of paper (recording medium), by an amount ($mm^3$/sec) equal to the amount by which air flows through the gap when the recording head (carriage) is moved for recording. Thus, this printer is also provided with the negative pressure generating means, which is located within the printer, without being attached to the ink jet recording head, and the piece of tube which keeps the recording head connected to the negative pressure generating means even while the recording head is moved for recording.

SUMMARY OF THE INVENTION

The primary object of the present invention is to provide a liquid ejection recording head and a liquid ejection recording apparatus, which are significantly smaller in the amount by which air flows into the gap between its liquid ejecting portion of the liquid ejection recording head and sheet of recording medium when the liquid ejection recording head is moved for recording, being therefore superior to a liquid ejection recording head and a liquid ejection recording apparatus, which are in accordance with the prior art, in terms of the accuracy with which each of the minuscule liquid droplets jetted from the liquid ejection recording head lands on a preset landing spot therefor on a sheet of recording medium.

According to an aspect of the present invention, there is provided a liquid ejection recording head comprising a liquid ejecting portion for ejecting liquid; a casing having a first side provided with said liquid ejecting portion, and a second side different from said first side; a first opening provided between said liquid ejecting portion and an edge of said first side; a second opening which is provided in said second side and which is in fluid communication with said first opening; and a projection provided in said second side between said second opening and such an edge of said second side as corresponds to said edge of said first side.

According to another aspect of the present invention, there is provided a liquid ejection type recording apparatus, comprising a liquid ejection recording head including, a casing having a first side provided with said liquid ejecting portion, and a second side different from said first side, a first opening provided between said liquid ejecting portion and an edge of said first side, a second opening which is provided in said second side and which is in fluid communication with said first opening, and a projection provided in said second side between said second opening and such an edge of said second side as corresponds to said edge of said first side; a scanning guiding portion for guiding a scanning movement of said liquid ejection recording head relative to a recording material; and wherein said first opening is disposed at a front side with respect to a scanning direction for recording, and said projection is disposed at a downstream side of said second opening with respect to the scanning direction.

According to a further aspect of the present invention, there is provided a liquid ejection type recording apparatus comprising a liquid ejection recording head for ejecting liquid onto a recording material; a carriage for carrying said liquid ejection recording head and for scanningly moving said recording liquid ejection recording head for effecting recording; a carriage casing having a first side for facing the recording material with said liquid ejecting portion, and a second side different from said first side; a first opening provided between said liquid ejecting portion and an edge of said first side; a second opening which is provided in said second side and which is in fluid communication with said first opening; a projection provided in said second side between said second opening and such an edge of said second side as corresponds to said edge of said first side; a scanning guiding portion for guiding a scanning movement of said liquid ejection recording head relative to a recording material; and a scanning guiding portion for guiding a scanning movement of said liquid ejection recording head relative to a recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. Incidentally, the embodiments of the present invention, which will be described hereinafter are those which are preferable from the technical standpoint, having therefore technical requirements. However, the following embodiments are not intended to limit the present invention in terms of the choice of an ink jet recording head and an ink jet recording apparatus, to which the present invention is applicable. That is, the present invention is applicable to any ink jet recording apparatus, as long as it is in accordance with the gist of the present invention.

Incidentally, the gist of the present invention is not related to the removal of the mist which minuscule liquid droplets form in the space between the surface of a liquid ejection recording head, which has the liquid ejecting openings, and a sheet of recording medium which is facing the surface, from the space. It is related to the minimization of the amount by which air flows into the space between the surface of the ink jet recording head, which has the liquid ejecting openings, and the sheet of recording medium, in order to prevent (minimize) the drifting of a liquid droplet, which occurs in the space. It also relates to the structural arrangement for minimizing the amount by which air flows into the space.

Embodiment 1

Figure 1:
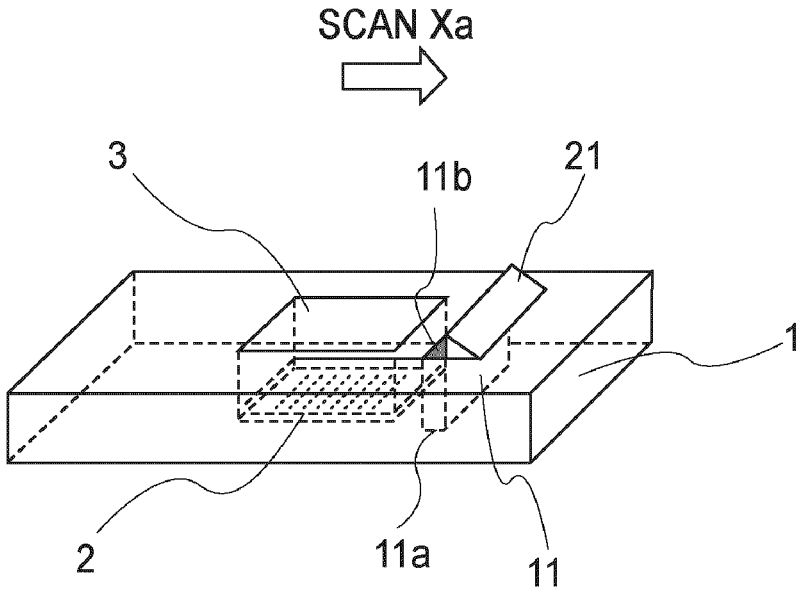
FIG. 1 is a perspective view of the ink jet recording head in the first embodiment of the present invention, showing the structure of the ink jet recording head.
Figure 2:
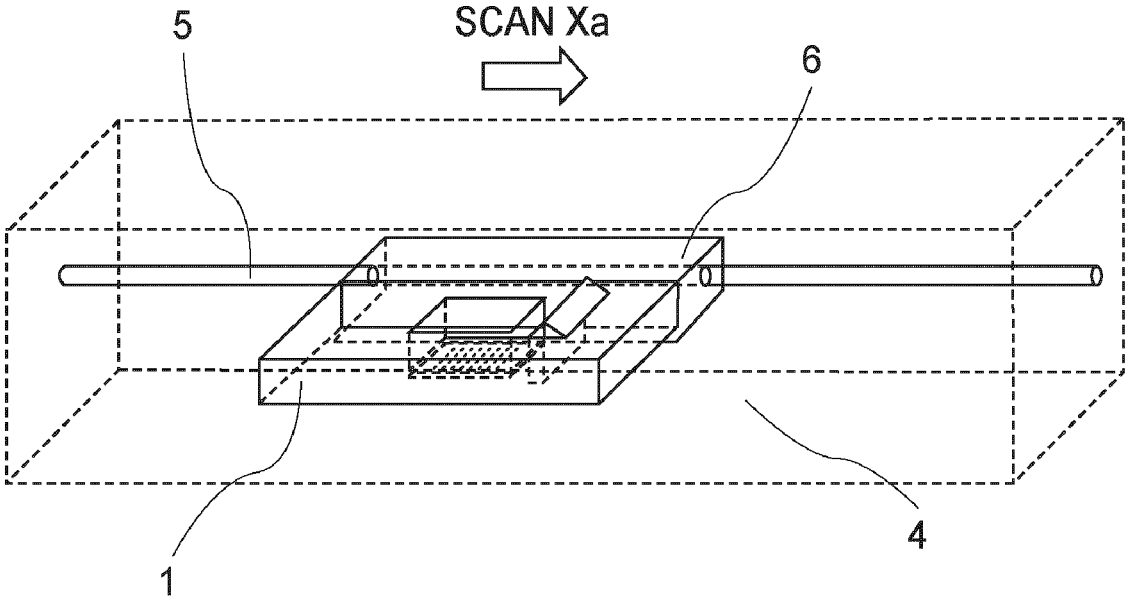
FIG. 2 is a perspective view of the ink jet recording apparatus having the ink jet recording head in the first embodiment of the present invention, showing the essential structure of the apparatus.

FIG. 1 is a perspective view of the ink jet recording head in the first embodiment of the present invention, showing the structure of the ink jet recording head. FIG. 2 is a perspective view of the ink jet recording apparatus having the ink jet recording head in the first embodiment of the present invention, showing the essential structure of the apparatus.

The ink jet recording apparatus 4 shown in FIG. 2 is made up of an ink jet recording head 1 shown in FIG. 1, a carriage 6 on which the ink jet recording head 1 is mountable, and a guiding member 5 along which the carriage 6 is reciprocally movable in a preset direction (for example, direction indicated by arrow mark Xa in drawing) while holding the ink jet recording head 1. The above-mentioned preset direction in which the carriage 6 (and ink jet recording head thereon) is reciprocally moved in an ordinary ink jet recording apparatus is intersectional (perpendicular) to the direction in which a sheet of recording medium is conveyed in the ink jet recording apparatus.

The means for moving the ink jet recording head 1 in the preset direction is not shown in the drawings; it may be a timing belt driven by a motor, for example. The ink jet recording head 1 is provided with a liquid ejecting portion 2, a liquid holding portion 3 (ink container), and a liquid delivery passage through which the liquid ejecting portion 2 is supplied with liquid (ink). The liquid ejecting portion 2 has multiple rows of liquid ejecting openings from which ink droplets are jetted. The multiple rows of liquid ejecting openings extend in parallel in the direction perpendicular to the direction in which the recording head is moved when ejecting liquid (ink).

In an image forming operation, the ink jet recording head 1 is (reciprocally) moved, while being guided by the guiding member 5, so that it (reciprocally) moves along the surface of a sheet of recording medium, such as paper, fabric, resinous substance, etc., so that an image is effected as the liquid droplets jetted from the ink jet recording head 1 land on the sheet of recording medium. The ink jet recording apparatus is structured so that a sheet of recording medium, such a sheet of paper, is conveyable, while being made to face the surface of the ink jet recording head 1, which coincides with the plane of the liquid ejecting opening, in the direction perpendicular to the direction in which the ink jet recording head 1 is (reciprocally) moved for image formation.

Next, the first of the preferred embodiments of the present invention will be described in more detail.

Figure 3:
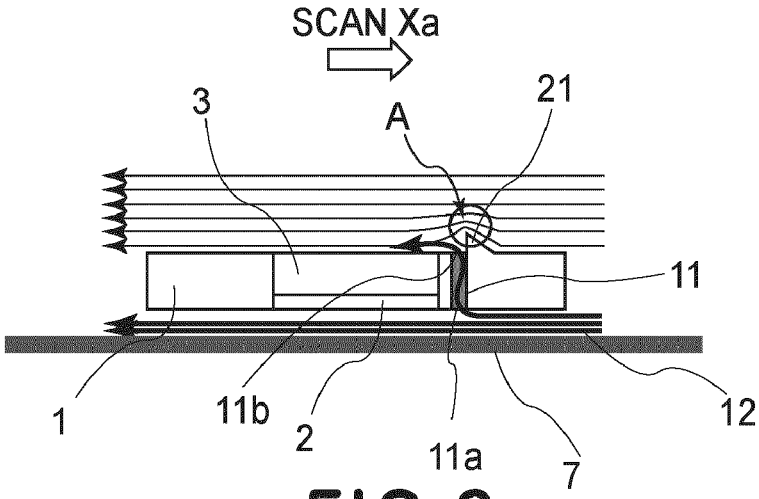
FIG. 3 is a schematic vertical sectional view of the first example of the ink jet recording heads of the first embodiment, and its adjacencies, showing the aerial current which flows along the surfaces of the ink jet recording head when the recording head is moved in the image forming direction.
Figure 4:
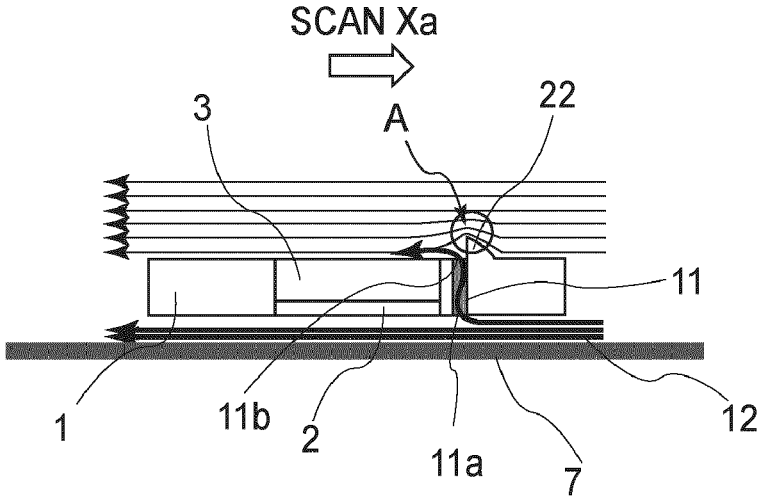
FIG. 4 is a schematic vertical sectional view of the second example of the ink jet recording heads of the first embodiment, which is different in the shape of its projection from the first example of the ink jet recording heads, and its adjacencies, showing the aerial current which flows along the surfaces of the ink jet recording head when the recording head is moved in the image forming direction.
Figure 5:
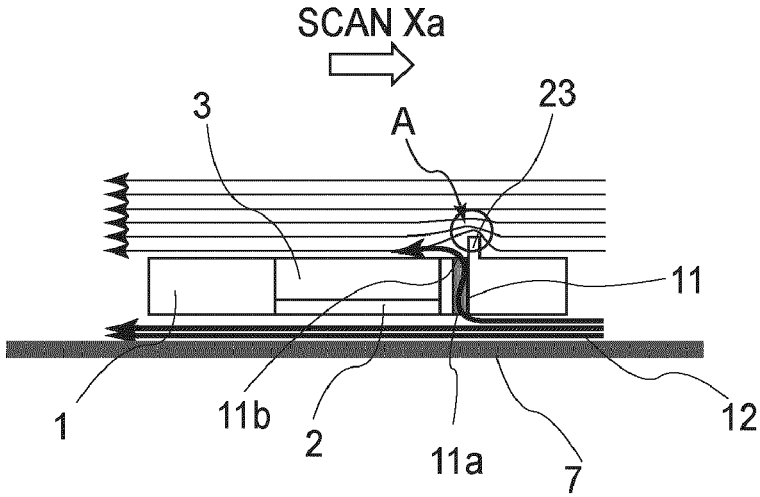
FIG. 5 is a schematic vertical sectional view of the third example of the ink jet recording heads of the first embodiment, which is different in the shape of its projection from the first and second examples of the ink jet recording heads, and its adjacencies, showing the aerial current which flows along the surfaces of the ink jet recording head when the recording head is moved in the image forming direction.
Figure 6:
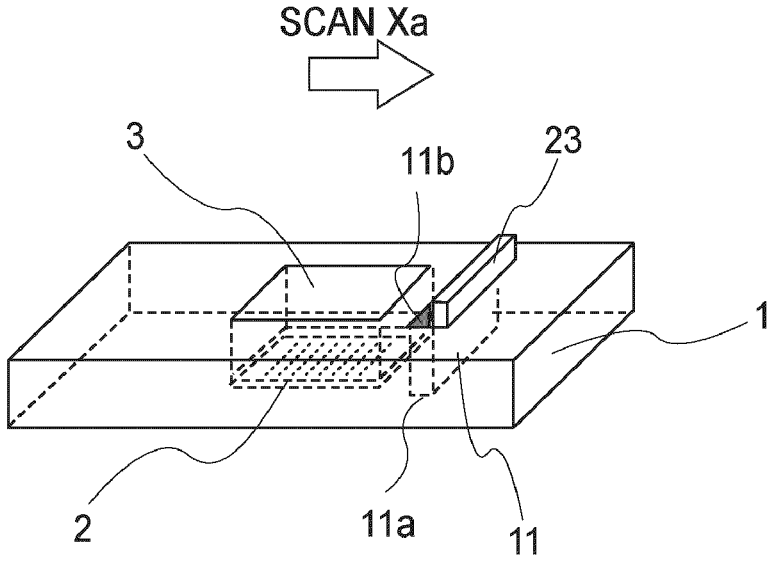
FIG. 6 is a schematic perspective view of the third example of the ink jet recording heads of the first embodiment, shown in FIG. 5.

FIG. 3 is a schematic vertical sectional view of the first example of the ink jet recording heads of the first embodiment, and its adjacencies, showing the aerial current which flows along the surfaces of the ink jet recording head when the recording head is moved in the image forming direction. FIG. 4 is a schematic vertical sectional view of the second example of the ink jet recording heads of the first embodiment, which is different in the shape of its projection from the first example of the ink jet recording head, and its adjacencies, showing the aerial current which flows along the surfaces of the ink jet recording head when the recording head is moved in the image forming direction. FIG. 5 is a schematic vertical sectional view of the third example of the ink jet recording heads of the first embodiment, which is different in the shape of its projection from the first and second examples of the ink jet recording heads, and its adjacencies, showing the aerial current which flows along the surfaces of the ink jet recording head when the recording head is moved in the image forming direction. FIG. 6 is a schematic perspective view of the third example of the ink jet recording heads of the first embodiment, shown in FIG. 5.

Referring to FIG. 3, as the ink jet recording head 1 is moved in the direction indicated by an arrow mark Xa, for example, that is, the direction in which the ink jet recording head 1 and sheet of recording medium are reciprocally moved relative to each other, an aerial current 12 occurs between the ink jet recording head 1 and sheet of recording medium (which hereafter will be referred to simply as recording medium). It is assumed here that the ink jet recording head 1 in this embodiment is in the form of a rectangular parallelepiped. It has a surface (first surface) which has the multiple liquid ejecting openings and is to face the recording medium, and a surface (second surface) which is on the opposite side of the ink jet recording head 1 from the first surface. It also has a hole 11, the opening 11*a* (first opening) of which is between the front edge (in terms of moving direction of ink jet recording head 1) of the first surface, that is, the surface having the liquid ejecting portion 2, and the liquid ejecting portion 2. This hole 11 is for partially guiding into the shell (housing) of the ink jet recording apparatus, the body of air which flows into the gap between the ink jet recording head 1 and recording medium 7 as the ink jet recording head 1 is moved for image formation. With the above described body of air being partially diverted through the hole 11, the aerial current 12, that is, the body of air which flows through the gap between the liquid ejecting portion 2 of the ink jet recording head 1, and recording medium 7, is significantly reduced in volume.

Incidentally, the ink jet recording apparatus 4 has only to be structured so that the first and second surfaces of the ink jet recording head 1 are parallel to the direction in which the ink jet recording head 1 is moved for image formation. The two surfaces do not necessarily need to oppose each other across the ink jet recording head 1. That is, they may be next to each other. The requirement regarding the positional relationship between these two surfaces is true with any of the following preferred embodiments of the present invention.

The opening 11*a* of the hole 11, which is on the forward side of the liquid ejecting portion 2 in terms of the recording movement of the ink jet recording head 1, is in connection with an opening 11*b*, which is on the opposite side of the ink jet recording head 1 from the liquid ejecting portion 2. The opening 11*b*, or the second opening, is in connection with the opening 11*a*, that is, the opening on the opposite side of the ink jet recording head 1 from the opening 11*b*, through the hole 11, that is, an air flow diversion passage. The air flow diversion passage 11, which is for reducing the aerial current 12 in volume, is an integral part of the shell portion (housing) of the ink jet recording head 1. Further, the ink jet recording head 1 is provided with a projection 21, which is on the surface having the opening 11*b* (air exit opening) of the air flow diversion passage 11, and projects from the front edge (in terms of printing movement of ink jet recording head 1) of the opening 11*b* in the direction perpendicular to the printing movement of the ink jet recording head 1). The air flow diversion passage 11 partially diverts the body of air made to flow into the aforementioned gap between the ink jet recording head 1 and recording medium 7 by the printing movement of the ink jet recording head 1, to the opposite side of the ink jet recording head 1 from the liquid ejecting portion 2, in order to reduce the aerial current 12 in volume. The projection 21 is on the upstream side of the opening 11*b* of the air flow diversion passage 11 in terms of the direction Xa (direction of air movement relative to movement of ink jet recording head 1), in other words, on the front side, in terms of the direction in which the ink jet recording head 1 is moved when it is actually recording.

When the ink jet recording head 1 is being moved for actually recording, air flows along the ink jet recording head 1. However, the body of air, which flows along the surface of the ink jet recording head 1, which has the projection 21, is interfered by the projection 21, being thereby bent as lineated in the portion of FIG. 3 designated by a referential letter A. As the air flow is bent as described above, pressure reduces on the inward side of the air flow curvature, that is, on the air flow exit opening 11*b* side of the air flow diversion passage 11. Consequently, the entrance side of the air flow diversion passage 11 becomes different in pressure from the exit side of the air flow diversion passage 11, increasing thereby the speed at which (volume by which) the body of air, which flows into the gap between the ink jet recording head and recording medium 7, is partially diverted into the air flow diversion passage 11, and is discharged from the opposite side of the air flow diversion passage 11 from the recording medium 7.

In particular, the air flow diversion passage 11 is on the upstream side of the liquid ejecting portion 2 in terms of the direction of the aerial current 12. Therefore, the aerial current 12, that is, the portion of the air flow between the liquid ejecting portion 2 and recording medium 7, which occurs when the ink jet recording head 1 is moved for printing as described above, reduces in volume.

As for the shape of the projection 21, in the first example the projection 21 is in the form of a trigonal prism laid on one of its lateral sides as shown in FIG. 1. However, it is not mandatory that the slanted surface of the projection 21 is flat as shown in FIG. 3 (sectional view). That is, in order to enable the projection 21 to better bend the air flow in its adjacencies, in the second example the surface of the projection, which opposes the air flow, may be curved as shown by projection 22 in FIG. 4 (sectional view). Further, in the third example the projection may be shaped like a squared pillar 23 as shown in FIG. 5 (sectional view) and FIG. 6 (perspective view).

The measurements, such as height, width, and length, of the projection 21, distance from the projection 21 to the air flow diversion passage 11, etc., should be set in consideration of the shape of the ink jet recording head 1, speed at which ink jet recording head 1 is moved for image formation, and also, the amount by which the aerial current 12, that is, the air flow between the liquid ejecting portion of the ink jet recording head 1 and recording medium 7 is to be reduced in volume. The structural arrangement described above can significantly reduce in volume the aerial current 12, being therefore capable of reducing the effect of the aerial current 12 upon the liquid droplets jetted from the liquid ejecting portion 2. Therefore, it can reduce the amount of liquid droplet drifting.

That is, the phenomenon that an image, having unwanted multiple stripes, each of which is darker than its adjacencies, and corresponds in position to the center portion of one of the multiple passes which the ink jet recording head 1 has to make to complete an image, is yielded because the liquid (ink) droplets jetted from the portion of the row of liquid (ink) ejecting openings, which is closer to the center of the row of liquid ejecting openings, are made to drift toward the center of the row of liquid (ink) ejecting openings more than the liquid (ink) droplets jetted from the end portion of the row of liquid ejecting openings, can be minimized in its effect without reducing the speed at which the ink jet recording head 1 is moved for printing.

Figure 7A:
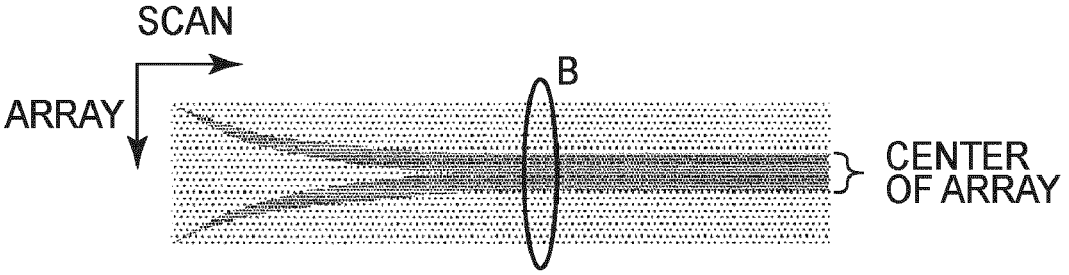
FIG. 7A is a portion of an image, which corresponds to one of the multiple passes which an ink jet recording head in accordance with the prior art makes to complete an image, showing the darker area (stripe) of the portion, which resulted across the middle of the portion, in terms of the direction perpendicular to the recording medium conveyance direction, due to the drifting of ink droplets.
Figure 7B:
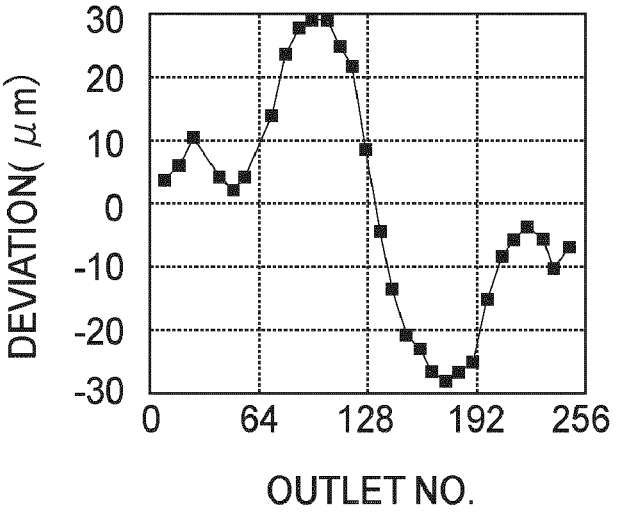
FIG. 7B is a graph which shows the amount of dot deviation, in terms of the direction parallel to the row of liquid ejecting openings, which occurs in an area B in FIG. 7A due to the drifting of the liquid droplets.

FIG. 7A is a schematic drawing of a portion of an image, which is formed by an ink jet recording head in accordance with the prior art, and which corresponds in position to one of the multiple passes which the ink jet recording head 1 has to make across the recording medium 7 to complete the image, and depicts the phenomenon that because the liquid (ink) droplets jetted from the portion of the row of liquid (ink) ejecting openings, which is closer to the center of the row of liquid (ink) ejecting openings, are made to drift toward the center of the row of liquid (ink) ejecting openings more than the liquid (ink) droplets jetted from the end portion of the row of liquid ejecting openings, an image suffering from unwanted multiple stripes, each of which is darker than its adjacencies, and corresponds in position to the center portion of one of the multiple passes which the ink jet recording head 1 has to make across the recording medium 7 to complete the image. FIG. 7B is a graph which shows the amount of dot deviation, in terms of the direction parallel to the row of liquid ejecting openings, which occurs in an area B (which is unwantedly darker across center portion in terms of direction perpendicular to moving direction of ink jet recording head 1) in FIG. 7A due to the drifting of the liquid droplets. The vertical axis of this graph represents the amount of the dot deviation attributable to the liquid droplet drift in the direction parallel to the row of liquid ejecting openings, and the horizontal axis represents the location of each liquid ejecting opening, which corresponds to the ordinal number of the opening in the row of liquid ejecting openings. The speed at which the ink jet recording head 1 moves across the surface of the recording medium 7 is 0.5 m/s, and the volume by which ink is jetted per ejection is 1 pl. The number of liquid ejecting openings is 256.

To describe how the graph in FIG. 7B is to be interpreted, if the amount of liquid droplet drift is 0, it means that the point on the recording medium 7, on which a liquid droplet jetted from a given liquid ejecting opening landed, coincides with the preset landing point for the liquid droplet. That is, the positive values which correspond to the first to 128-th liquid ejecting openings, counting from one of the lengthwise ends of the row of liquid ejecting openings, mean that the points on which the liquid droplets from these liquid ejecting openings landed are offset toward the center of the liquid ejecting opening row from the preset ones, whereas the negative values indicate that the points on which the liquid droplets landed are offset toward the end of the liquid ejecting opening row. It should be noted here that the 129-th to 256-th liquid ejecting openings, counting from the aforementioned lengthwise end of the liquid ejecting opening row, are opposite in terms of positivity (negativity) from the first to 128-th liquid ejecting openings. The distance between the point on the recording medium 7, on which a liquid droplet jetted from a given liquid ejecting opening actually landed, and the preset point on which the liquid droplet was to land, will be referred to as amount of dot deviation.

It is evident from FIG. 7B (graph) that the closer to the center of the row of liquid ejecting openings, the greater the amount of liquid droplet drift. The greater the amount of liquid droplet drift, the closer the distance between the adjacent two dots resulting from the landing of the adjacent two liquid droplets on the recording medium 7, and the amount by which the adjacent two dots resulting from the landing of the adjacent two liquid droplets on the recording medium 7 overlap with each other. This is why the drifting of liquid droplets toward the center of the row of liquid ejecting openings results in the formation of an image suffering from multiple stripes, each of which is darker than its adjacent area, and corresponds in position to the center portion of one of the multiple passes which the ink jet recording head 1 has to make across the recording medium 7 to complete the image, as shown in FIG. 7A.

Figure 8A:
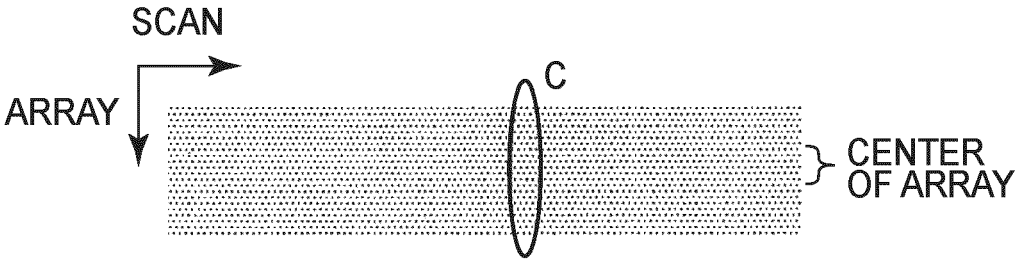
FIG. 8A is a portion of an image, which corresponds to one of the multiple passes which an ink jet recording head in accordance with the present invention makes to complete an image, showing the darker area (stripe) of the portion, which resulted across the middle of the portion, in terms of the recording medium conveyance direction, due to the drifting of ink droplets.
Figure 8B:
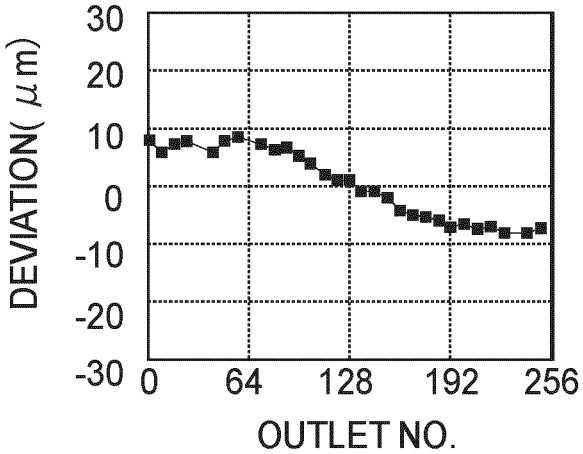
FIG. 8B is a graph which shows the amount of dot deviation, in terms of the direction parallel to the row of liquid ejecting openings, which occurs in an area C in FIG. 8A due to the drifting of the liquid droplets.

In comparison, FIG. 8A schematically shows a portion of an image, which is formed by the ink jet recording head 1 in this embodiment, and corresponds to one of the multiple passes which the ink jet recording head 1 has to make across the recording medium 7 to complete the image. FIG. 8B is a graph showing the relationship between the amount of liquid droplet drift and the liquid ejecting opening location, in the area C shown in FIG. 8B, which corresponds to the area B in FIG. 7B, which shows the relationship between the amount of dot deviation (resulting from liquid droplet drift) and the liquid ejecting opening location of the comparative ink jet recording head 1, that is, the ink jet recording head in accordance with the prior art. It is evident from FIG. 8B (graph) that in the case of the ink jet recording head 1 in this embodiment, the line formed by connecting the points showing the amount of dot deviation, which is equivalent to the amount of liquid droplet drift, is gentle in form, and the maximum amount of dot deviation was no more than 20 μm. This is why an image formed by the ink jet recording head 1 in this embodiment does not suffer from the multiple stripes, each of which is darker than its adjacent area, and corresponds in position to the center portion of one of the multiple passes which the ink jet recording head 1 has to make across the recording medium 7 to complete the image, as shown in FIG. 7A.

Embodiment 2

Figure 9:
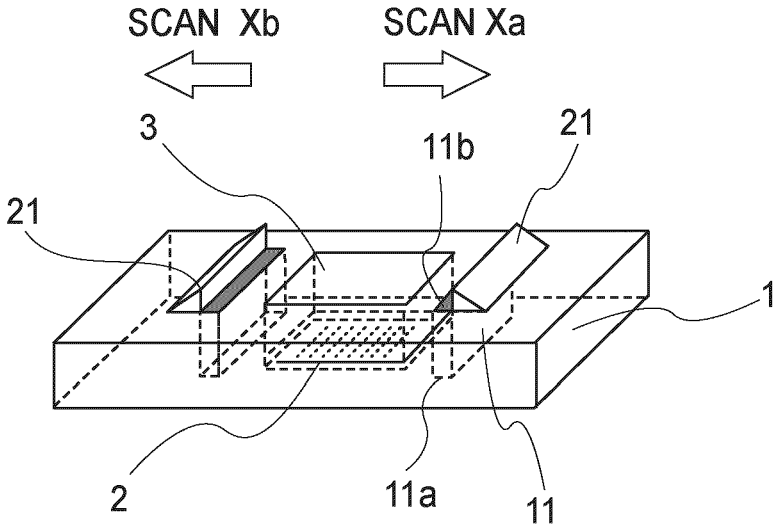
FIG. 9 is a perspective view of the ink jet recording head in the second embodiment of the present invention, showing the essential structure of the ink jet recording head.

Next, the second of the preferred embodiments of the present invention will be described. FIG. 9 is a perspective view of the ink jet recording head in the second embodiment of the present invention, showing the essential structure of the ink jet recording head. Incidentally, the ink jet recording apparatus in which the ink jet recording head 1 in this embodiment is mounted is the same in essential structural as that in which the ink jet recording head 1 in the first embodiment is mounted. Therefore, its drawing is not provided, and also, it will not be described.

Next, the second of the preferred embodiments of the present invention will be described regarding essentially characteristic features of this embodiment, which are different from those of the first embodiment. The portions of the ink jet recording head and ink jet recording apparatus in this embodiment, which will not be described, are the same as those in the first embodiment.

As the ink jet recording head 1 is moved relative to the recording medium 7 in the direction Xa or Xb, that is, the direction perpendicular to the direction in which the recording medium 7 is conveyed, air is made to flow between the ink jet recording head 1 and recording medium 7. In order to reduce the amount by which air flows between the liquid ejecting portion of the ink jet recording head 1 and recording medium 7, the ink jet recording head 1 is provided with a pair of air flow diversion passages 11, and a pair of projections 21. The pair of air flow diversion passages 11 are positioned so that they sandwich the liquid ejecting portion 2 of the ink jet recording head 1 in terms of the moving direction of the ink jet recording head 1. The pair of projections 21 are positioned next to the outward edge of the air exit opening of the air flow diversion passage 11.

Further, the pair of projections 21 are enabled to change in position so that when the ink jet recording head 1 is moving for image formation, the projection 21 which is on the leading side in terms of the moving direction of the ink jet recording head 1 remains projected, whereas the projection 21 which is on the trailing side remains retracted in the shell of an ink jet recording head 1. For example, referring to FIG. 9, when the ink jet recording head 1 is moved in the direction Xa, the projection 21 which is on the right hand side in FIG. 9 remains projected, whereas the projection 21 which is on the left hand side in FIG. 9 remains hidden, that is, stored in the ink jet recording head 1.

Figure 10:
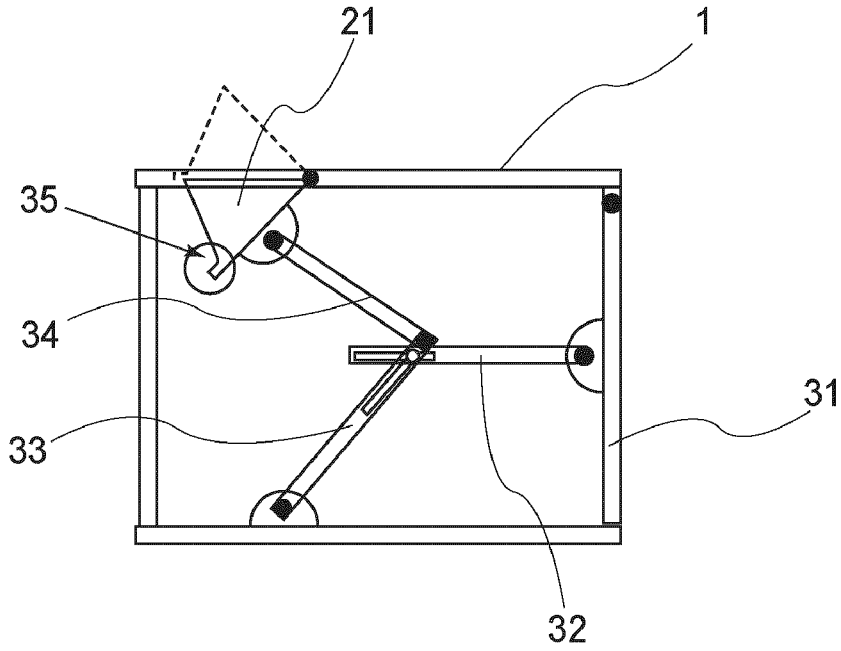
FIG. 10 is a schematic sectional view of one of a pair of projections 21*a* with which the ink jet recording head in the second embodiment is provided, and the mechanism with which the ink jet recording head in the second embodiment is provided to make the projections 21*a* project or retract, showing the state of the ink jet recording head, in which the projection is in the ink jet recording head.
Figure 11:
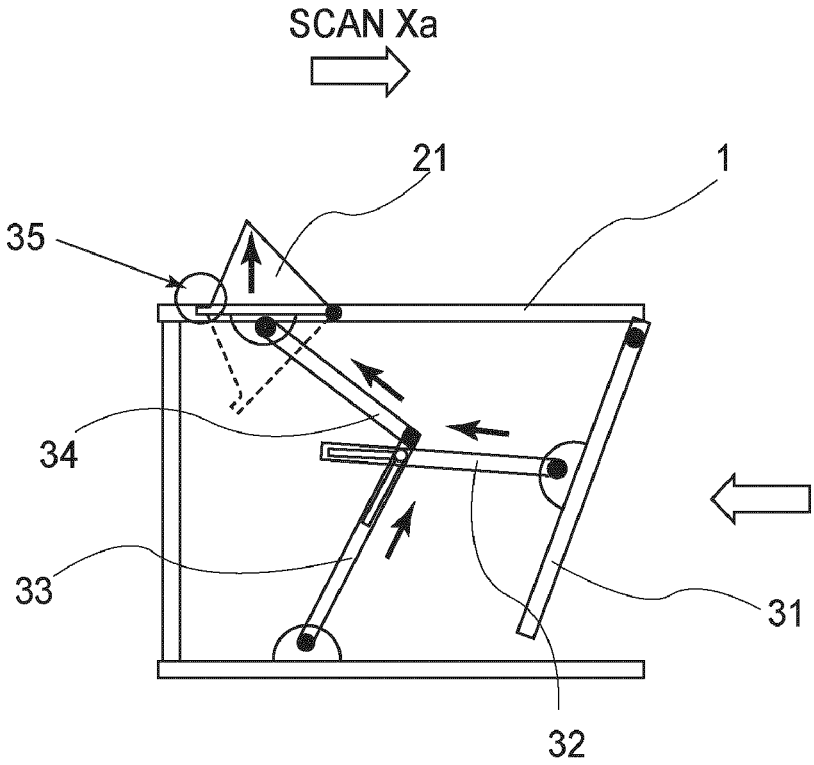
FIG. 11 is a schematic sectional view of one of a pair of projections 21*a* with which the ink jet recording head in the second embodiment is provided, and the mechanism with which the ink jet recording head in the second embodiment is provided to make the projections 21*a* project or retract, showing the state of the ink jet recording head, in which the projection is projecting from the ink jet recording head in the ink jet recording head.

FIGS. 10 and 11 are schematic sectional views of one of the projections 21 and the mechanism for making the projection 21 project or retract.

As the ink jet recording head 1 which is in the state shown in FIG. 10 is moved in the direction Xa, a plate 31 is pressed by the pressure generated by air resistance. As the plate 31 is pressed, connecting rods 32, 33, and 34 are moved. Consequently, the projection 21, which is in the ink jet recording head 1, is made to emerge from the shell of the ink jet recording head 1, on the side opposite from the side which faces the recording medium 7. As the projection 21 projects a preset distance, it is stopped by a stopper with which the projection 21 is provided.

Then, as the ink jet recording head 1 begins to be moved in the direction to eliminate the pressure which is being applied on the plate 31 , that is, as the ink jet recording head 1 begins to be moved in the direction opposite to the direction Xa, the plate 32 returns to the home position, retracting thereby the projection 21 into the shell of the ink jet recording head 1. In this embodiment, the mechanism for making the projection 21 project or retract utilizes the pressure generated by the movement of the ink jet recording head 1. However, the mechanism may be made up of an electrically movable diaphragm.

Providing the ink jet recording head 1 with the pair of air flow diversion passages 11 positioned as described above can enable the ink jet recording head 1 to bidirectionally record, making it thereby possible to significantly reduce the length of time the ink jet recording head 1 is required to move across the recording medium 7 to complete each copy.

As for the shape of the projection 21, it does not need to conform to that in the first embodiment.

The results of the tests, in which the ink jet recording head 1 in this embodiment was used to record images in two way recording, are the same as those shown in FIGS. 8A and 8B, which show the test results of the ink jet recording head and ink jet recording apparatus in the first embodiment.

Embodiment 3

Figure 12:
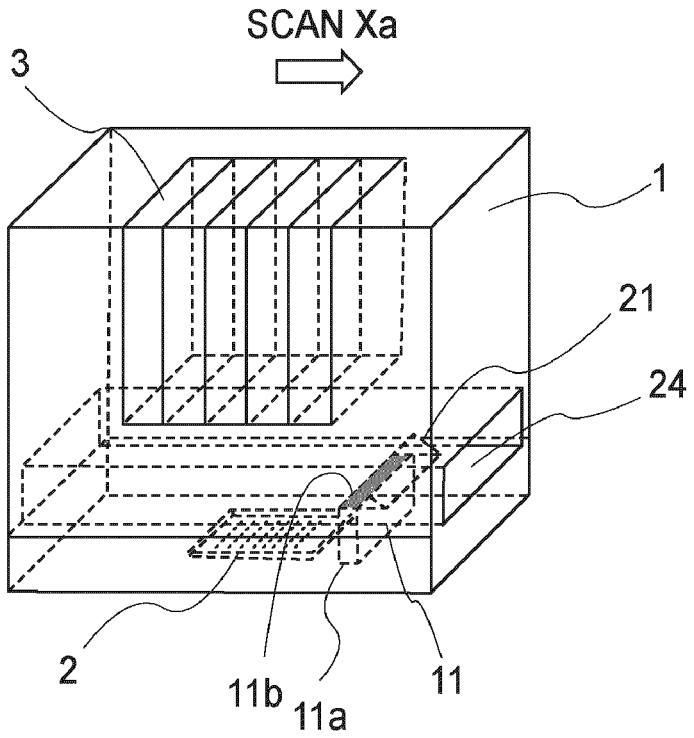
FIG. 12 is a perspective view of the ink jet recording head in the third embodiment of the present invention, showing the structure of the ink jet recording head.
Figure 13:
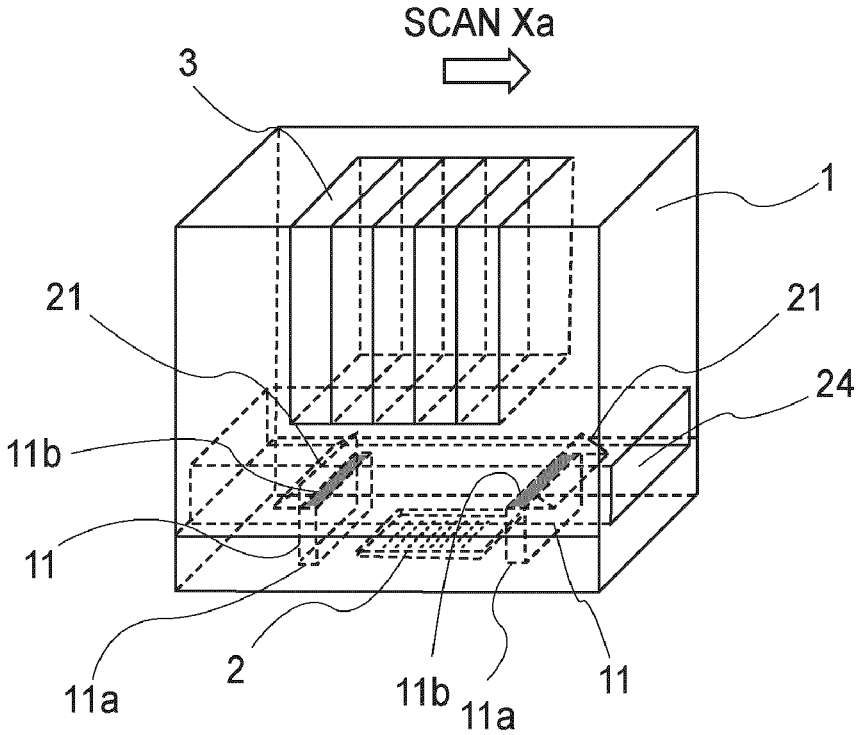
FIG. 13 is a perspective view of a modified version (capable of bidirectionally recording) of the ink jet recording head shown in FIG. 12.

Next, the third of the preferred embodiments of the present invention will be described. FIGS. 12 and 13 are perspective views of the ink jet recording head in the third embodiment of the present invention, showing the essential structure of the ink jet recording head. Incidentally, the ink jet recording apparatus in which the ink jet recording head 1 in this embodiment is mounted is the same in essential structural as that in which the ink jet recording head 1 in the first embodiment is mounted. Therefore, its drawing will not be provided, and also, it will not be described. This embodiment is similar to the first and second embodiments, except that the liquid holding portion 3 (ink container) of the ink jet recording head 1 in this embodiment is significantly greater in capacity than those in the first and second embodiments.

Next, the third of the preferred embodiments of the present invention will be described regarding essentially the characteristic features of this embodiment, which are different from those of the first embodiment. The portions of the ink jet recording head and ink jet recording apparatus in this embodiment, which will not be described, are the same in structure as those in the first embodiment.

As the ink jet recording head 1 is moved relative to the recording medium 7 in the direction Xa, for example, that is, the direction perpendicular to the direction in which the recording medium 7 is conveyed, an air flow occurs between the ink jet recording head 1 and recording medium 7.

Increasing the liquid holding portion 3 in capacity increases the shell (housing) of the ink jet recording head 1 in overall size, which in turn makes longer the air flow diversion passage 11 which is provided in the ink jet recording head 1 to reduce the amount by which air is made to flow between the ink jet recording head 1 and recording medium 7. Thus, in this embodiment, in order to reduce in length the air flow diversion passage 11, the ink jet recording head 1 is provided with a through-hole 24 which extends in the direction parallel to the moving direction of the ink jet recording head 1. Further, the ink jet recording head 1 is structured so that the plane of the air exit opening 11*b* of the air flow diversion passage 11 coincides with the bottom surface (in FIGS. 12 and 13) of the through-hole 24. Further, the ink jet recording head 1 is provided with a projection 21, which is positioned next to the leading edge of the air exit opening of the air flow diversion passage 11 in terms of the moving direction of the ink jet recording head 1.

Figure 14:
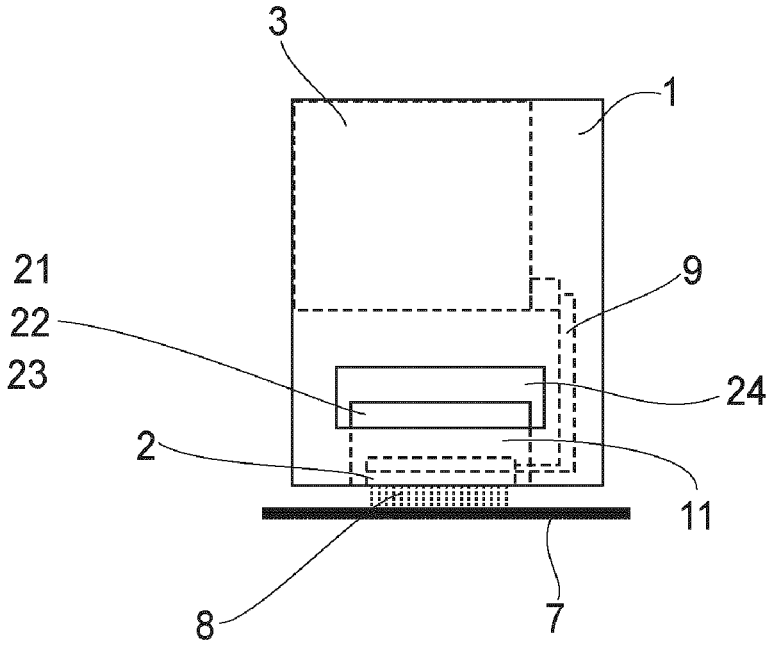
FIG. 14 is a side view of the ink jet recording head shown in FIG. 12, as seen from the direction parallel to the direction in which the ink jet recording head is reciprocally moved for image formation, showing the state in which the ink jet recording head is ejecting ink.

Further, the ink jet recording head 1 is provided with an ink delivery passage 9, which extends from the liquid holding portion 3 to liquid ejecting portion 2 in a manner to circumvent the through-hole 24 (FIG. 14).

Providing the ink jet recording head 1 with the ink delivery passage 9 makes it possible to position the through-hole 24 close to the liquid ejecting portion 2 while positioning the liquid holding portion 3 away from the liquid ejecting portion 2. Therefore, it makes it possible to reduce the length of the air flow diversion passage 11. Reducing the air flow diversion passage 11 in length reduces the air flow diversion passage 11 in air flow resistance, which in turn significantly reduces the amount by which air enters (flows) between the liquid ejecting portion 2 of the ink jet recording head 1 and recording medium 7. Therefore, the effect which the aerial current between the liquid ejecting portion 2 of the ink jet recording head 1 and recording medium 7 has on the liquid droplets jetted from the liquid ejecting portion 2 is reduced. In other words, the liquid droplets jetted from the liquid ejecting portion 2 are reduced in the amount by which they are made to drift by the aerial current between the liquid ejecting portion 2 of the ink jet recording head 1 and recording medium 7.

Further, referring to FIG. 13, the ink jet recording head 1 may be provided with a pair of air flow diversion passages 11, which are positioned in a manner to sandwich the liquid ejecting portion 2 in terms of the moving direction of the ink jet recording head 1, and a pair of projections 21, which are positioned next to the pair of air flow diversion passages 11, one for one. More specifically, the ink jet recording head 1 may be structured so that the plane of the air exit opening of the air flow diversion passage 11 coincides with the bottom surface (FIGS. 12 and 13) of the through-hole 24, and also, so that each projection 21 is positioned so that it will be next to the leading edge of the corresponding air flow diversion passage 11 in terms of the moving direction of the ink jet recording head 1. Structuring an ink jet recording head 1 as described above makes it possible for the ink jet recording head 1 to bidirectionally record.

The shape and measurement of the through-hole 24 should be set in consideration of the length and shape of the air flow diversion passage 11, and the size and shape of the projections 21, 22 and 23, which are positioned next to the air exit opening of the air flow diversion passage 11. It also should be set in consideration of how much the air flow which occurs between the ink jet recording head 1 and recording medium 7 is affected by the shape of the ink jet recording head 11, speed at which the ink jet recording head 1 is moved for recording, shape of the internal space of the shell (housing) of the ink jet recording apparatus 4, and the like factors.

The results of the tests in which the ink jet recording head 1 in this embodiment was used to record images, are the same as those shown in FIGS. 8A and 8B, which show the test results of the ink jet recording head in the first embodiment.

Embodiment 4

In any of the preceding three embodiments of the present invention, the ink jet recording head 1 has the liquid ejecting portion 2 and liquid holding portion 3, and also, it has the air flow diversion passage 11 and projections 21, 22, and/or 23.

Figure 15:
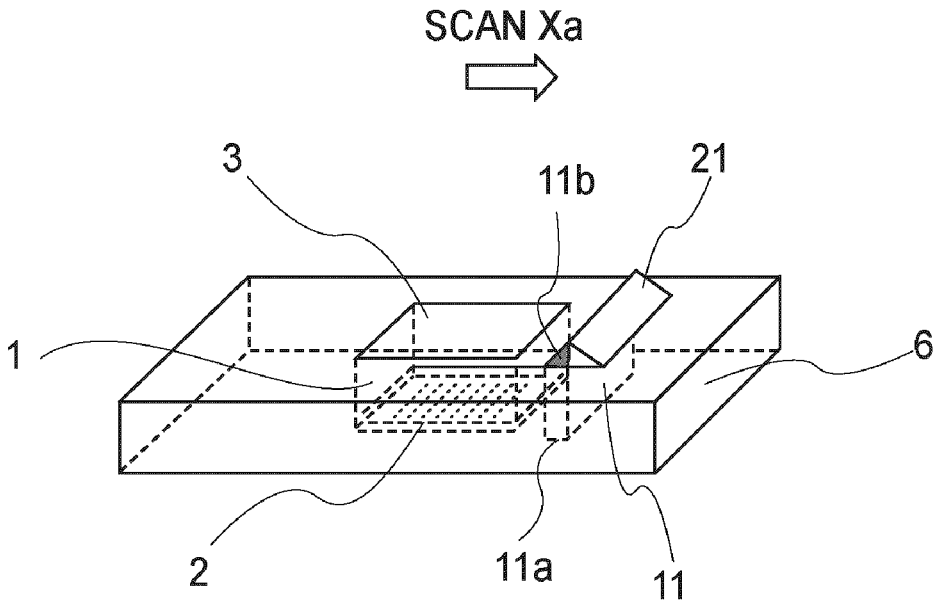
FIG. 15 is a perspective view of the ink jet recording head in the fourth embodiment of the present invention, which is made up of a liquid ejecting portion and a liquid holding portion, and is removably mountable on a carriage provided with an air flow diversion passage, showing the structure of the ink jet recording head.

In this embodiment, it is not the ink jet recording head 1, but the carriage 6 that is provided with the air flow diversion passage 11 and projections 21, 22 and/or 23. For example, FIG. 15 is a perspective view of the ink jet recording head 1 and carriage 6 in this embodiment. The ink jet recording head 1 has the liquid ejecting portion 2 and liquid holding portion 3, and is removably mountable on the carriage 6. The carriage 6 is provided with the air flow diversion passage 11. The carriage 6 is structured so that the plane of the air entrance opening 11*a* of the air flow diversion passage 11 coincides with the surface of the shell of the carriage 6, which faces the recording medium, and the plane of the air exit opening 11*b* of the air flow diversion passage 11 coincides with the opposite surface of the shell of the carriage 6 from the surface which faces the recording medium.

The ink jet recording head 1 shown in FIG. 15 corresponds in structure to that in the first embodiment. However, the structural arrangement for the ink jet recording head 1 and carriage 6 in this embodiment is also compatible with those in the second and third embodiments, although the drawings therefor are not provided here.

Further, the effect equivalent to those obtained by the ink jet recording head 1 in any of the preceding embodiments can be obtained by a combination of an ink jet recording head having the liquid ejecting portion and liquid holding portion, and a carriage having the air flow diversion passage 11 and one or more of the projections 21, 22 and 23.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application Nos. 325950/2006 and 270108/2007 filed Dec. 1, 2006 and Oct. 17, 2007, respectively, and which are hereby incorporated by reference herein.

What is claimed is:

1. A liquid ejection recording head comprising:

a liquid ejecting portion for ejecting liquid;

a casing having a first side provided with said liquid ejecting portion, and a second side different from said first side;

a first opening provided between said liquid ejecting portion and an edge of said first side;

a second opening which is provided in said second side and which is in fluid communication with said first opening; and a projection provided at said second side between said second opening and an edge of said second side that corresponds to said edge of said first side.

2. A liquid ejection recording head according to claim 1, wherein said projection is retractable into said casing.

3. A liquid ejection recording head according to claim 1, further comprising a penetrated portion penetrating said casing to define said second side, wherein said second opening is disposed in an inner surface of the penetrated portion, and a liquid supply path, formed in a side wall defining said penetrated portion, for supplying the liquid to said liquid ejecting portion.

4. A liquid ejection recording head according to claim 1, wherein said edges of said first and second sides are disposed at a leading side with respect to a direction of a scanning operation carried out for recording.

5. A liquid ejection recording head according to claim 1, further comprising an air discharging flow path for fluid communication between said first opening and said second opening to discharge air flow produced between said liquid ejecting head and the recording material during a printing operation using said liquid ejection recording head.

6. A liquid ejection type recording apparatus, comprising:

a liquid ejection recording head including a liquid ejecting portion for ejecting liquid, a casing having a first side provided with said liquid ejecting portion, and a second side different from said first side, a first opening provided between said liquid ejecting portion and an edge of said first side, a second opening which is provided in said second side and which is in fluid communication with said first opening, and a projection provided at said second side between said second opening and an edge of said second side that corresponds to said edge of said first side; and a scanning guiding portion for guiding a scanning movement of said liquid ejection recording head relative to a recording material, wherein said first opening is disposed adjacent a front side with respect to a scanning direction for recording, and said projection is disposed at a downstream side of said second opening with respect to the scanning direction.

7. An apparatus according to claim 6, wherein said projection is retractable into said casing.

8. An apparatus according to claim 6, further comprising a penetrated portion penetrating said casing to define said second side, wherein said second opening is disposed in an inner surface of the penetrated portion, and a liquid supply path, formed in a side wall defining said penetrated portion, for supplying the liquid to said liquid ejecting portion.

9. An apparatus according to claim 6, further comprising an air discharging flow path for fluid communication between said first opening and said second opening to discharge air flow produced between said liquid ejecting head and the recording material during a printing operation using said liquid ejection recording head.

10. A liquid ejection type recording apparatus comprising:

a liquid ejection recording head for ejecting liquid onto a recording material;

a carriage for carrying said liquid ejection recording head and for scanningly moving said recording liquid ejection recording head for effecting recording;

a carriage casing having a first side for facing the recording material with said liquid ejection recording head, and a second side different from said first side;

a first opening provided between said liquid ejection recording head and an edge of said first side;

a second opening which is provided in said second side and which is in fluid communication with said first opening;

a projection provided at said second side between said second opening and an edge of said second side that corresponds to said edge of said first side; and a scanning guiding portion for guiding a scanning movement of said carriage relative to a recording material.

11. An apparatus according to claim 10, wherein said projection is retractable into said carriage casing.

12. An apparatus according to claim 10, further comprising an air discharging flow path for fluid communication between said first opening and said second opening to discharge air flow produced between said liquid ejection recording head and the recording material during a printing operation while scanningly moving said carriage with said liquid ejection recording head.

* * * * *